US009744558B2

(12) United States Patent
Shinoda et al.

(10) Patent No.: US 9,744,558 B2
(45) Date of Patent: Aug. 29, 2017

(54) COATING METHOD AND COATING DEVICE

(71) Applicant: MAZDA MOTOR CORPORATION, Hiroshima (JP)

(72) Inventors: Masafumi Shinoda, Hiroshima (JP); Minoru Kimura, Salamanca (MX); Tatsuo Tsuneoka, Higashi-Hiroshima (JP); Fumi Hirano, Aki-gun (JP)

(73) Assignee: MAZDA MOTOR CORPORATION, Hirsoshima (JP)

( * ) Notice: Subject to any disclaimer, the term of this patent is extended or adjusted under 35 U.S.C. 154(b) by 93 days.

(21) Appl. No.: 14/426,963

(22) PCT Filed: Mar. 11, 2013

(86) PCT No.: PCT/JP2013/001566

§ 371 (c)(1),
(2) Date: Mar. 9, 2015

(87) PCT Pub. No.: WO2014/045473

PCT Pub. Date: Mar. 27, 2014

(65) Prior Publication Data

US 2015/0273496 A1 Oct. 1, 2015

(30) Foreign Application Priority Data

Sep. 19, 2012 (JP) ..... 2012-206183

(51) Int. Cl.

| | |
|---|---|
| ***B05D 1/40*** | (2006.01) |
| ***B05D 1/02*** | (2006.01) |
| ***B05B 5/08*** | (2006.01) |
| ***B05B 1/34*** | (2006.01) |
| ***B05D 1/04*** | (2006.01) |
| ***B05D 7/14*** | (2006.01) |

(Continued)

(52) U.S. Cl.

CPC ..... *B05D 1/40* (2013.01); *B05B 1/3405* (2013.01); *B05B 5/0407* (2013.01); *B05B 5/08* (2013.01); *B05B 13/0431* (2013.01); *B05D 1/02* (2013.01); *B05D 1/04* (2013.01); *B05D 7/14* (2013.01); *B05B 5/04* (2013.01)

(58) Field of Classification Search

None

See application file for complete search history.

(56) References Cited

FOREIGN PATENT DOCUMENTS

| | | |
|---|---|---|
| CN | 2058350 U | 6/1990 |
| CN | 1575866 A | 2/2005 |

(Continued)

OTHER PUBLICATIONS

International Search Report; PCT/JP2013/001566; Jun. 11, 2013.

(Continued)

*Primary Examiner* — Michael P Rodriguez

(74) *Attorney, Agent, or Firm* — Studebaker & Brackett PC

(57) ABSTRACT

The present invention is intended to solve a problem that a coating film has an uneven thickness in the case where a coating target 1 has a stepped portion extending in a predetermined direction on its coating surface. To solve the problem, a follow-up coating is performed along the stepped portion S extending in the predetermined direction after coating of the entire coating surface of the coating target 1 so that paint mist adheres more to a relatively-recessed side of the stepped portion S.

6 Claims, 10 Drawing Sheets

(51) Int. Cl.
*B05B 13/04* (2006.01)
*B05B 5/04* (2006.01)

(56) References Cited

FOREIGN PATENT DOCUMENTS

| | | | | |
|---|---|---|---|---|
| JP | 2003-033717 | A | | 2/2003 |
| JP | 3769858 | B2 | | 2/2006 |
| JP | 2007-237099 | A | | 9/2007 |
| JP | 2007237099 | A | * | 9/2007 |
| JP | 2011-212632 | A | | 10/2011 |

OTHER PUBLICATIONS

"Surface decoration for metal furniture"; China; pp. 1-4; with partial English translation.
"Key problems which should be paid attention to in the process of body skin repair"; China; pp. 1-5; with partial English translation.

* cited by examiner (A)

(B)

(C)

COATING METHOD AND COATING DEVICE

TECHNICAL FIELD

The present invention relates to coating methods and coating devices for providing an electrostatic coating on a coating target having a stepped portion on a coating surface.

BACKGROUND ART

Electrostatic coating is widely applied to automotive bodies, cases of home appliances, and so on. It is known in the electrostatic coating that the state of paint adhesion to a coating target is easily changed according to coating conditions, such as a moving speed of a coating gun, an amount of paint sprayed, and the distance between the coating gun and the coating target. For example, Patent Document 1 discloses that when an automotive body is coated using a rotating bell-type coating gun moving in one direction along a coating surface of the automotive body, the amount of paint adhesion to the automotive body differs between the right side and the left side of the movement path of the coating gun. According to the coating control method disclosed in Patent Document 1, a first standard pattern of a coating film formed in a forward movement of the rotating bell-type coating gun, and a second standard pattern of a coating film formed in a backward movement of the rotating bell-type coating gun are formed under predetermined coating conditions, and these standard patterns are synthesized to create film thickness distribution data. Through the evaluation of the film thickness distribution data, coating conditions that allow uniform film thickness distribution of the coating film are selected, and the coating is controlled based on the coating conditions.

CITATION LIST

Patent Document

Patent Document 1: Japanese Patent No. 3769858

SUMMARY OF THE INVENTION

Technical Problem

An automobile in its body coating process is not yet provided with a mechanism which keeps a door locked to the automotive body. Thus, during coating, the door is held on the automotive body by a jig so that the opening of the automotive body is almost closed by the door. Thus, for example, as illustrated in FIG. 13, the rear end of the front door a and the front end of the rear door b are not flush with each other, and have a small step therebetween. If electrostatic coating is performed on the automotive body having such a stepped portion S, a large amount of charged paint mist (i.e., atomized paint particles for coating a target, and the same hereinafter) d is attracted to the rear end of the front door a near the coating gun c, and as illustrated in FIG. 14, the coating film e is locally thick at the rear end of the front door a, whereas the coating film e is locally thin at the front end of the rear door b. As a result, as illustrated in FIG. 15, the color is dark at the rear end portion of the front door a, and is light at the front end portion of the rear door b, along the boundary between the front door a and the rear door b, and this deteriorates the appearance. This phenomenon also occurs at a boundary portion between the rear door b and a rear fender f.

Particularly in the case of a coating film whose visible light transmission properties are high, the difference in the density of the color due to uneven thickness of the coating film is significant since a transmittance of the visible light varies depending on the thickness of the coating film. If the thickness of the coating film as a whole is thick, a slight difference in the local film thickness is less likely to increase the difference in the density of the color. However, in the case of thin film coating, the difference in the film thickness significantly affects the difference in the density of the color.

The present invention is intended to solve the problem that if a coating target has a stepped portion on its coating surface as described above, a coating film formed thereon has an uneven thickness.

Solution to the Problem

To solve the above problem, in the present invention, an electrostatic coating on a coating target having a stepped portion on a coating surface includes a follow-up coating after an entire surface coating.

A coating method disclosed herein is a method for providing an electrostatic coating on a coating target having, on a coating surface, a stepped portion extending in a predetermined direction, and the method includes: a first step of providing an entire surface coating on the entire coating surface of the coating target; and a second step of providing, after the entire surface coating, a follow-up coating along the stepped portion extending in the predetermined direction so that paint mist adheres more to a relatively-recessed side of the stepped portion.

In the first step of the coating method, the coating film has different thicknesses at the stepped portion since charged paint mist is attracted more to the relatively-projected side of the stepped portion in coating the stepped portion. That is, the coating film at the relatively-projected side of the stepped portion is thick, and the coating film at the relatively-recessed side of the stepped portion is thin. Since the follow-up coating is provided in the second step along the stepped portion such that the paint mist adheres more to the relatively-recessed side of the stepped portion, the differences in thickness of the coating film at the stepped portion are reduced by the follow-up coating.

In a preferred embodiment of the coating method, a rotating bell-type coating gun by which the paint mist is supplied while swirling about a center of a bell is used in the second step, and the follow-up coating is provided using the characteristics of the rotating bell-type coating gun.

In the rotating bell-type coating gun, the paint mist is ejected to the coating target, while swirling about the center of the bell due to the rotation of the bell. When the coating gun is moved in one direction, swirling of the paint mist is reduced on one side of a movement line of the bell center due to air resistance caused by the movement of the coating gun, since the paint mist is ejected while swirling. As a result, straightness of the paint mist going to the coating target from the coating gun increases, and therefore, an amount of adhesion of the paint mist to the coating target is increased near the coating gun. On the other side of the movement line of the bell center, the paint mist is easily scattered due to the air resistance, and therefore, the amount of adhesion of the paint mist to the coating target is reduced near the coating gun.

In a preferred embodiment, the rotating bell-type coating gun is moved only in one direction along the stepped portion extending in the predetermined direction, with one side of the rotating bell-type coating gun, where swirling of the paint mist is reduced due to air resistance, facing the relatively-recessed side (i.e., the side where the coating film is thin) of the stepped portion. As a result, in the follow-up coating, the paint mist adheres more to the relatively-recessed side than to the relatively-projected side of the stepped portion, and the differences in thickness of the coating film at the stepped portion can be reduced. Since the follow-up coating is provided using the characteristics of the rotating bell-type coating gun, a small coating gun suitable for local coating is not necessarily needed, and the same coating gun as used in the entire surface coating can be used to provide the follow-up coating.

In a preferred embodiment of the coating method, the coating target includes a pair of coating surfaces facing in opposite directions, and the coating surfaces have the stepped portions arranged symmetrically, and in the follow-up coating, the coating gun moves along the stepped portions on the coating surfaces of the coating target in opposite directions so that the one side where the swirling of the paint mist is reduced due to the air resistance caused by the movement of the coating gun face the relatively-recessed side of each of the stepped portions on the coating surfaces of the coating target.

For example, an automobile is substantially symmetrical when viewed from the front, and thus, as described earlier, the shape of the stepped portion at a boundary between the front door and the rear door in a coating process, and the shape of the stepped portion at a boundary between the rear door and the rear fender are symmetrical to those on the opposite side. Further, as mentioned above, the amount of adhesion of the paint mist is increased on one side of the movement line of the rotating bell-type coating gun, and the amount of adhesion of the paint mist is reduced on the other side of the movement line of the rotating bell-type coating gun.

Thus, in the case where the stepped portions are arranged symmetrically on the coating surfaces facing in opposite directions, the coating gun moves on the coating surfaces in opposite directions so that the one side where the swirling of the paint mist is reduced due to the air resistance caused by the movement of the rotating bell-type coating gun face the relatively-recessed side of the stepped portion on the coating surfaces of the coating target. This method can reduce the differences in thickness of the coating film at the stepped portion on each of the coating surfaces.

In a preferred embodiment of the coating method, the follow-up coating is provided by only 1 pass of the coating gun along the stepped portion. This method reduces the movement loss of the coating gun, and advantageously reduces cycle time.

In a preferred embodiment of the coating method, after the entire surface coating using a coating gun, the follow-up coating is provided using the same coating gun. It is thus not necessary to provide a coating gun dedicated for use in each of the entire surface coating and the follow-up coating, and equipment costs are advantageously reduced.

In a preferred embodiment of the coating method, the follow-up coating is provided by an oblique spray of paint from the relatively-recessed side to a relatively-projected side of the stepped portion, using a coating gun. This method allows one side of the coating gun to be brought close to the relatively-recessed side of the stepped portion, and the paint mist to adhere more to the recessed side. That is, the differences in thickness of the coating film are advantageously reduced.

In a preferred embodiment of the coating method, a coating film formed by the entire surface coating and the follow-up coating has a visible light transmittance of 40% or more and 70% or less (more preferably 40% or more and 60% or less). As mentioned earlier, the phenomenon that the difference in thickness of the coating film causes the difference in the density of the color, is significant in the case of a coating film whose visible light transmission properties are high. By adopting the above coating method in forming such a coating film, it is possible to effectively reduce the difference in the density of the color caused by the difference in thickness of the coating film.

Further, a coating device disclosed herein is a coating device which provides an electrostatic coating on a coating target having, on a coating surface, a stepped portion extending in a predetermined direction, and which is directly used in the implementation of the coating method. The device includes: at least one electrostatic coating machine having a movable coating gun; and a control device which drives the electrostatic coating machine to provide an entire surface coating on the entire coating surface by moving the coating gun across the entire coating surface of the coating target, and which drives the electrostatic coating machine used in the entire surface coating or another electrostatic coating machine to provide a follow-up coating by moving the coating gun along the stepped portion extending in the predetermined direction so that paint mist adheres more to a relatively-recessed side of the stepped portion.

Thus, the differences in thickness of the coating film between the relatively-projected side and the relatively-recessed side of the stepped portion in the entire surface coating are reduced by the follow-up coating in which paint mist adheres more to the relatively-recessed side of the stepped portion.

In a preferred embodiment of the coating device, a rotating bell-type coating gun by which the paint mist is supplied while swirling about a center of a bell is used in the follow-up coating, and when the coating gun is moved in one direction along the stepped portion extending in the predetermined direction, swirling of the paint mist is reduced on one side of a movement line of a bell center of the coating gun due to air resistance caused by the movement of the coating gun, and the coating gun is moved only in the one direction along the stepped portion, with the one side facing the relatively-recessed side of the stepped portion. As a result, in the follow-up coating, the paint mist adheres more to the relatively-recessed side than to the relatively-projected side of the stepped portion, and the differences in thickness of the coating film at the stepped portion can be reduced.

In a preferred embodiment of the coating device, the coating target includes a pair of coating surfaces facing in opposite directions, and the coating surfaces have the stepped portions arranged symmetrically, and in the follow-up coating, the coating gun moves along the stepped portions on the coating surfaces of the coating target in opposite directions so that the one side where the swirling of the paint mist is reduced due to the air resistance caused by the movement of the coating gun face the relatively-recessed side of each of the stepped portions on the coating surfaces of the coating target. As a result, in the follow-up coating, the paint mist adheres more to the relatively-recessed side than to the relatively-projected side of the stepped portion on each of the coating surfaces of the coating targets, and the differences in thickness of the coating film at the stepped portion can be reduced on each of the coating surfaces of the coating targets.

In a preferred embodiment of the coating device, the follow-up coating is provided by only 1 pass of the coating gun along the stepped portion. Thus, the movement loss of the coating gun is prevented, and the cycle time is advantageously reduced.

In a preferred embodiment of the coating device, the follow-up coating is provided using the electrostatic coating machine used in the entire surface coating. It is thus not necessary to provide an electrostatic coating machine dedicated for used in each of the entire surface coating and the follow-up coating, and equipment costs are advantageously reduced.

In a preferred embodiment of the coating device, in the follow-up coating, the coating gun is controlled such that paint is obliquely sprayed from the relatively-recessed side to a relatively-projected side of the stepped portion. Thus, one side of the coating gun can be brought close to the relatively-recessed side of the stepped portion, and the paint mist adheres more to the recessed side. That is, the differences in thickness of the coating film are advantageously reduced.

Advantages of the Invention

According to the present invention, in providing an electrostatic coating on a coating target having, on a coating surface, a stepped portion extending in a predetermined direction, a follow-up coating is provided along the stepped portion extending in the predetermined direction after coating the entire coating surface of the coating target, such that paint mist adheres more to a relatively-recessed side of the stepped portion. Thus, the differences in thickness of the coating film between the relatively-projected side and the relatively-recessed side of the stepped portion are reduced, and the difference in the density of the color is avoided.

DESCRIPTION OF EMBODIMENTS

An embodiment of the present invention will be described below, based on the drawings. The following embodiment is a merely preferred example in nature, and is not intended to limit the scope, applications, and use of the invention.

Figure 1:
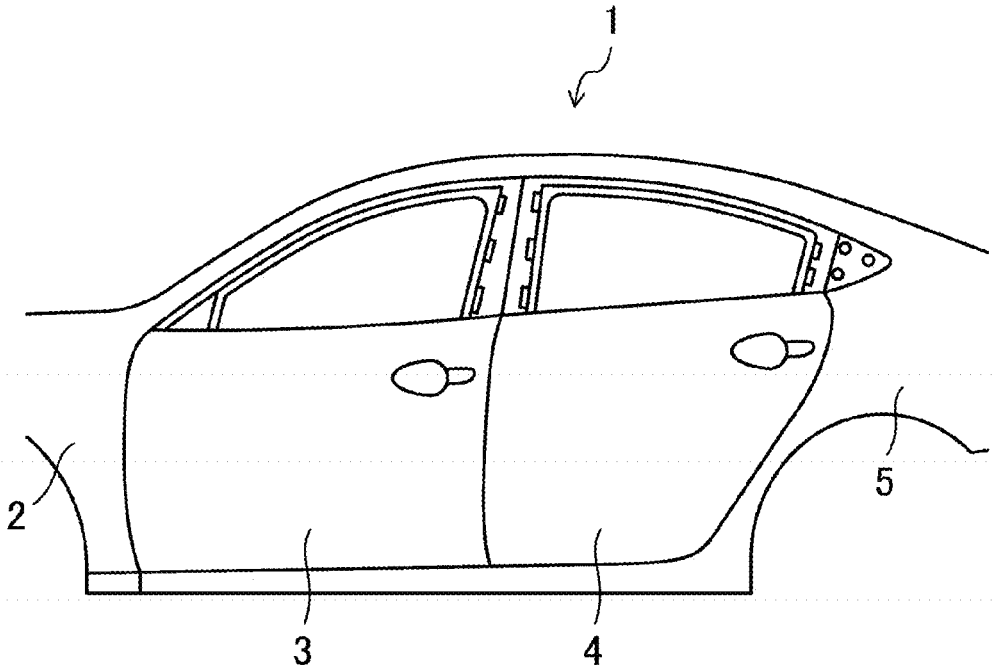
FIG. 1 is a side view showing part of an automobile as a coating target.
Figure 2:
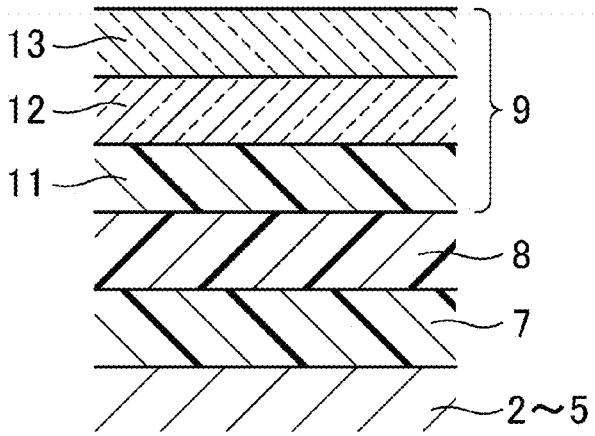
FIG. 2 is a cross-sectional view showing a configuration of a coating film of the automobile.

FIG. 1 is an automobile 1 as a coating target to which electrostatic coating is given by a coating method and a coating device of the present invention. In the drawing, the reference character 2 is a front fender, 3 is a front door, 4 is a rear door, and 5 is a rear fender. The side panels 2-5 and top panels (i.e., a hood, a roof and a trunk lid), which comprise outer plates of the automobile, are provided with a base (electrodeposition) coating film 7, an intermediate coating film 8, and a top coating film 9 as shown in FIG. 2. The top coating film 9 includes a first base coating film 11 whose visible light reflectance is high, a second base coating film 12 whose visible light transmittance is high, and a clear coating film 13. The visible light transmittance of the second base coating film 12 is 40% or more and 70% or less (more preferably 40% or more and 60% or less).

Figure 3:
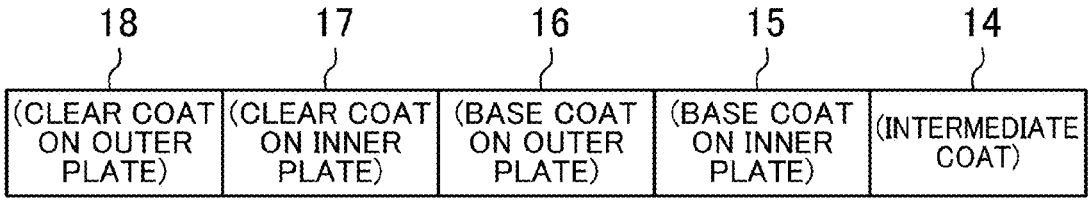
FIG. 3 schematically illustrates a coating line of the automobile.

FIG. 3 schematically illustrates a coating line. In the coating line, the automobile 1 on which the base coating film has been formed is given an intermediate coating and a top coating. That is, the coating line has a first station 14 where the intermediate coating is performed on the outer plates and inner plates, a second station 15 where the base coating is performed on the inner plates, a third station 16 where the base coating is performed on the outer plates, a fourth station 17 where the clear coating is performed on the inner plates, and a fifth station 18 where the clear coating is performed on the outer plates. The inner plates are inner sides of open/close members, such as the front door 3, the rear door 4, and the hood, a side frame outer portion of a pillar, etc., which is overlapped with the open/close members, and an engine compartment, etc. The coating line is provided with a carrier means by which the automobile is sequentially carried from the first to fifth stations 14-18. A coating robot (an electrostatic coating machine) is placed in each of the stations 14-18.

In the second station 15 and the fourth station 17, a general air spray coating may be adopted instead of the electrostatic coating. In the stations 15 and 17, a hand coating by a worker may be adopted instead of using the coating robot.

Coating techniques characteristic of the present invention are adopted in forming the second base coating film 12 on the side panels 2-5 in the third station 16. The concrete techniques will be described below.

Figure 4:
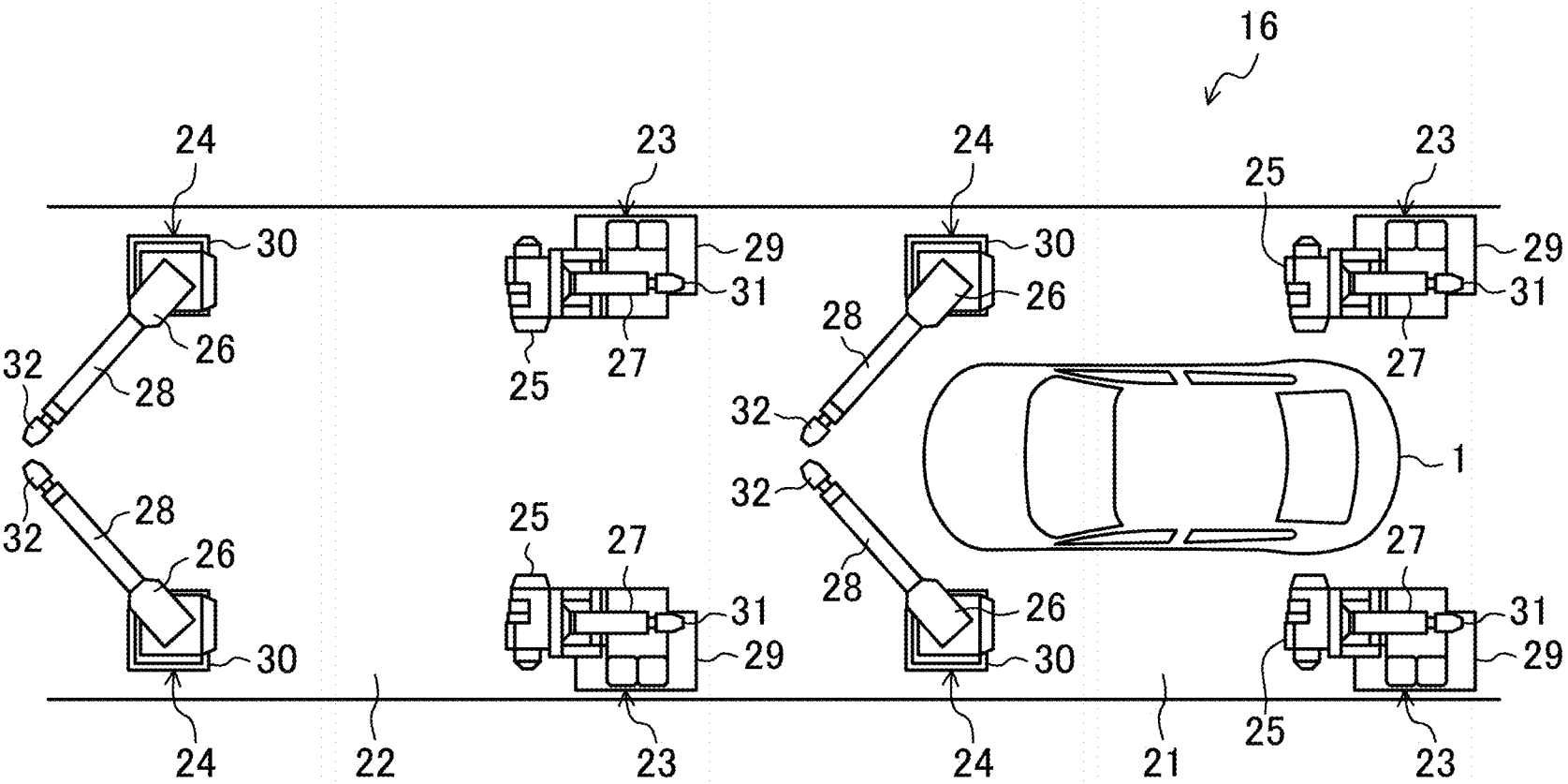
FIG. 4 is a plan view of a station where a base coating is provided on outer plates of the automobile.

FIG. 4 illustrates the third station 16. The third station 16 includes a first coat section 21 where the first base coating film 11 is formed on the outer plates, and a second coat section 22 where the second base coating film 12 is formed on the outer plates. Side coating robots 23 for coating the side panels 2-5, and top coating robots 24 for coating the top panels are placed in each of the first and second coat sections 21, 22. The side and top coating robots 23, 24 are arranged on both sides of the automobile carrier line, one on each side. Each of the coating robots 23, 24 is configured by a robot body 25, 26 having a robot arm 27, 28 and supported on a robot base 29, 30. A rotating bell-type coating gun 31, 32 for an electrostatic coating is attached to an end of the robot arm 27, 28.

The coating device has a control device (not shown) which drives the coating robots 23, 24 as the electrostatic coating machines. The robot arms 27, 28 are driven based on three-dimensional teaching information given to the control device, and coating is performed by the coating guns 31, 32 drawing a predetermined path.

Coating control by the side coating robot 23 in the first coat section 21 will be explained first. The side panels 2-5 on the left and right sides of the automobile are coated by the side coating robots 23 on both sides of the carrier line.

Figure 5:
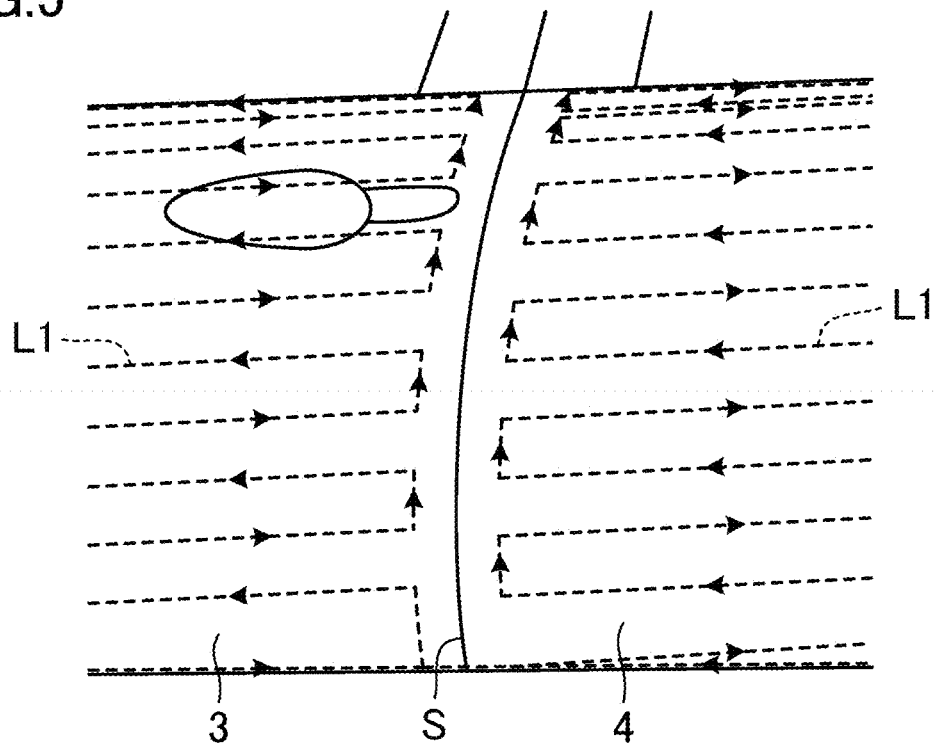
FIG. 5 is a side view showing part of the automobile on which a movement path of a coating gun in forming a first base coating film is drawn.

FIG. 5 shows a movement path L1 of the coating gun 31 at a time when the coating gun 31 provides a coating on the entire surfaces of the doors 3, 4, based on the teaching information given to the side coating robot 23. The coating gun 31 moves along the surfaces of the doors 3, 4. In the example of the drawing, the coating gun 31 alternately repeats, in each of the doors 3, 4, a frontward horizontal movement followed by an upward movement by a predetermined distance, and a rearward horizontal movement followed by an upward movement by a predetermined distance. As a result, the entire surfaces of the doors 3, 4 are coated. The movement path of the coating gun 31 is determined such that the paint adhesion area by the frontward horizontal movement and the paint adhesion area by the rearward horizontal movement partially overlap each other. The front fender 2 and the rear fender 5 are coated by the side coating robot 23 in a similar manner as to the doors 3, 4. The first base coating film 11 is formed on the side panels 2-5 in this manner.

The top panels (i.e., a hood, a roof and a trunk lid), too, are coated by the top coating robots 24 on both sides of the carrier line, basically in a similar manner as to the side panels 2-5, by forming the first base coating film 11 by making the coating gun 32 move along a predetermined path.

Next, coating control by the side coating robot 23 in the second coat section 22 will be explained. The side panels 2-5 on the left and right sides of the automobile are coated by the side coating robots 23 on both sides of the carrier line.

Figure 13:
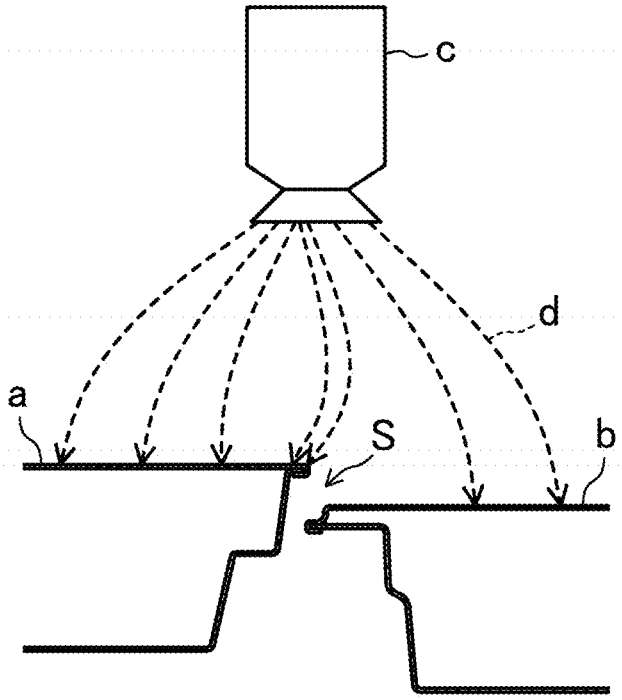
FIG. 13 is a cross-sectional view showing that paint mist from the electrostatic coating gun is attracted more to a relatively-projected side of the stepped portion.
Figure 14:
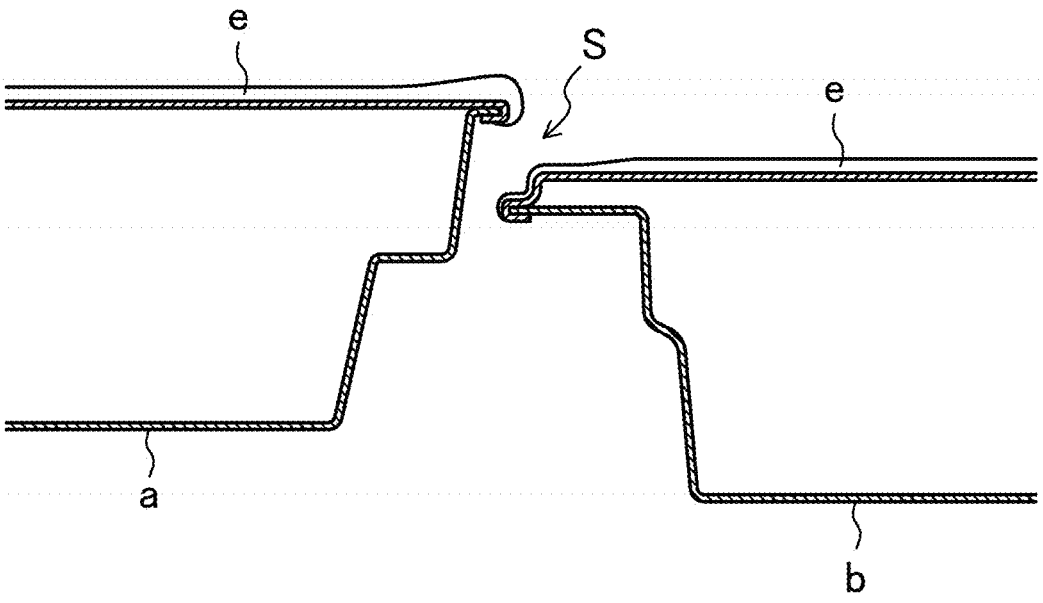
FIG. 14 is a cross-sectional view of part of an automobile, in which the thickness of the coating film formed by a conventional coating method is drawn exaggeratedly.
Figure 15:
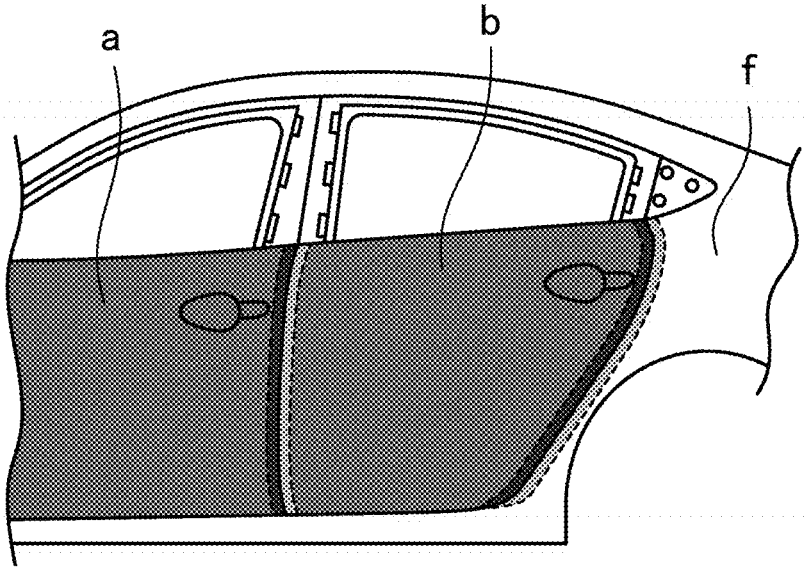
FIG. 15 is a side view of part of an automobile for exaggeratedly showing that an uneven thickness of the coating film causes a difference in the density of the coating color.

As was described earlier, in providing a coating on an automobile, the doors 3, 4 are held on the automotive body by a jig so that door openings in the automotive body are almost closed by the doors 3, 4. Therefore, a small step is formed between the rear end of the front door 3 and the front end of the rear door 4 (see FIG. 13). A similar step is also formed between the rear end of the rear door 4 and the front end of the rear fender 5. Due to the steps, if the same entire surface coating as in the first coat section 21 is performed, the thickness of the coating film on a relatively-projected side of the vertically-extending stepped portion S is locally increased, and the thickness of the coating film on a relatively-recessed side of the stepped portion S is locally reduced (see FIG. 14).

The present invention is intended to solve the problem that the film thickness is locally increased on one side of the stepped portion S and is locally reduced on the other side of the stepped portion S. In the entire surface coating on the side panels 2-5 in the first coat section 21, too, the film thickness is locally increased on one side of the stepped portion S and is locally reduced on the other side of the stepped portion S. However, since the first base coating film 11 whose visible light reflectance is high is used in the first coat section 21, the film thickness differences lead to almost no differences in the density of the coating color, and it does not particularly matter whether the film thickness is locally increased/reduced. On the other hand, since the second base coating film 12 whose visible light transmittance is high is used in the second coat section 22, which means that film thickness differences easily lead to differences in the density of color, it matters whether the film thickness is locally increased/reduced at the stepped portion S.

Thus, the side coating robot 23 in the second coat section 22 is controlled such that it performs a local follow-up coating after the entire surface coating on the entire surfaces of the side panels 2-5.

Figure 6:
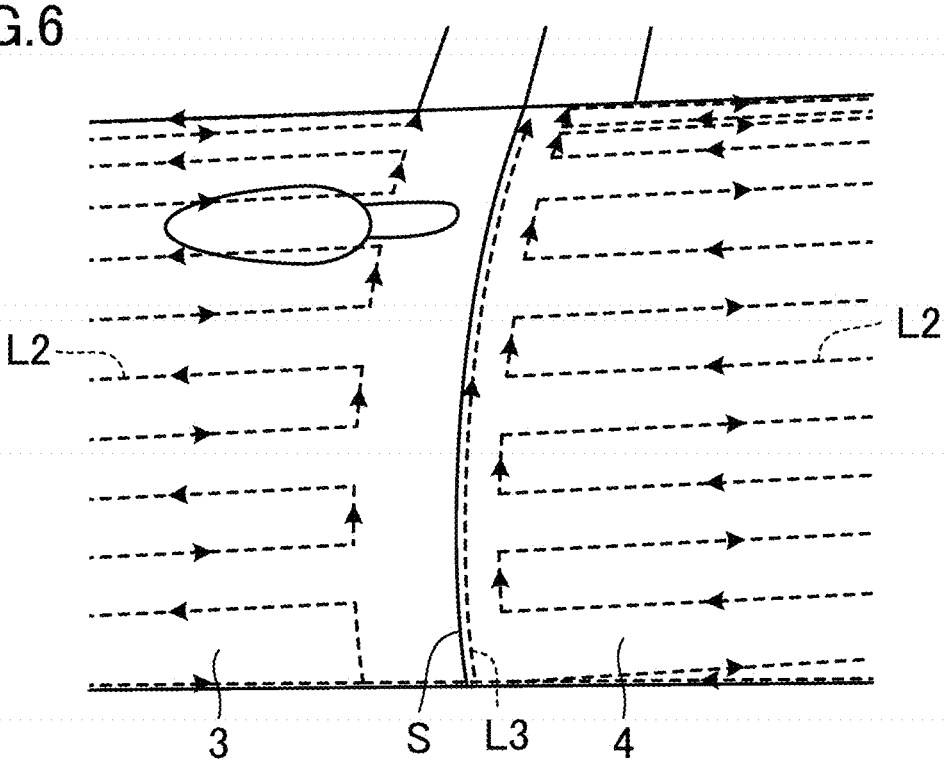
FIG. 6 is a side view showing part of the automobile on which a movement path of the coating gun in forming a second base coating film (an entire surface coating and a follow-up coating) is drawn.

FIG. 6 shows a movement path L2 of the coating gun 31 at a time when the coating gun 31 provides a coating on the entire surfaces of the doors 3, 4, and a movement path L3 of the coating gun 31 at a time when the coating gun 31 provides a follow-up coating, based on the teaching information given to the side coating robot 23. The coating gun 31 moves along the surfaces of the doors 3, 4.

Basically, similarly to the first coat section 21, in the entire surface coating in the second coat section 22, as well, the side coating robot 23 is controlled such that the coating gun 31 repeats a frontward horizontal movement, an upward movement by a predetermined distance, a rearward horizontal movement, and an upward movement by a predetermined distance as shown in FIG. 6. However, different from the moving area of the coating gun 31 in the first coat section 21, the moving area of the coating gun 31 in the entire surface coating in the second coat section 22 is reduced to its forward-most limit That is, the rear end position of the horizontal movement path in the entire surface coating in the second coat section 22 is shifted forward of the rear end position of the horizontal movement path in the entire surface coating in the first coat section 21, within a range that allows the coating film to reach the rear ends of the doors 3, 4. This can reduce a local increase of the thickness of the coating film at the relatively-projected rear ends of the doors 3, 4. However, even if the moving area of the coating gun 31 in the entire surface coating is determined as described above, it does not solve the problem that the thickness of the coating film is reduced at the relatively-recessed front end of the rear door 4 and the relatively-recessed front end of the rear fender 5.

To solve this problem, the side coating robot 23 is controlled to provide a follow-up coating along the stepped portion S after the entire surface coating. That is, a follow-up coating is performed so that the paint mist adheres more to the relatively-recessed side of the stepped portion S. The follow-up coating is performed by the coating gun 31 moving in one direction along the stepped portion S in an extending direction of the stepped portion S.

If the coating gun 31 in the follow-up coating is controlled to a direct facing spray posture in which paint is sprayed on the stepped portion S from a face-to-face position as in the entire surface coating, the advantage of the follow-up coating, that is, obtaining a uniform thickness of the film, is reduced even if the coating gun 31 is directed to the relatively-recessed side of the stepped portion S. This is because in the direct facing spray, the paint mist is also attracted to the relatively-projected side of the stepped portion S, and does not necessarily adhere more to the relatively-recessed side of the stepped portion S.

Figure 7:
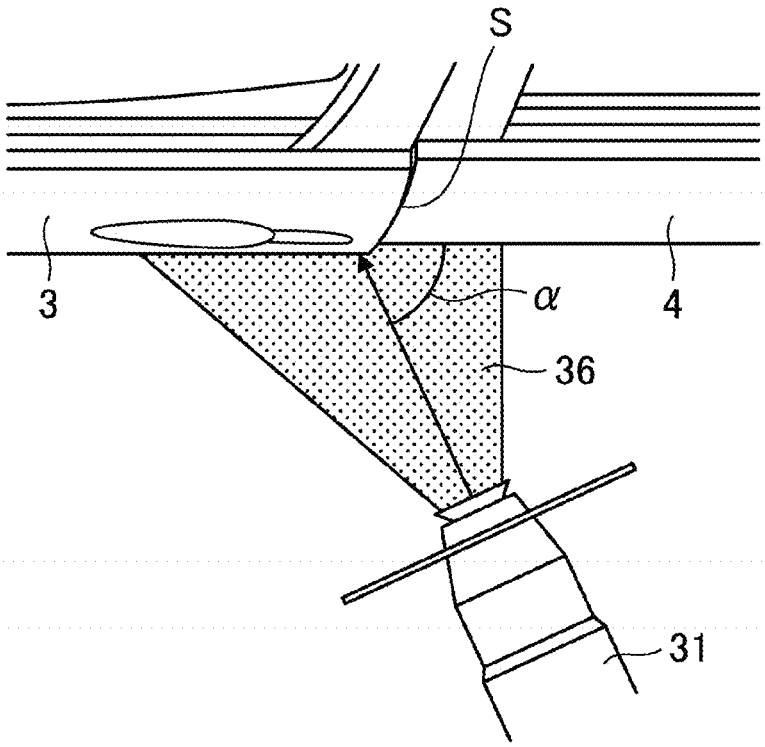
FIG. 7 is a plan view showing a relationship between the coating gun and the automobile in the follow-up coating.

Thus, as shown in FIG. 7, in the follow-up coating, the coating gun 31 is controlled to a posture in which paint is sprayed obliquely from the relatively-recessed side to the relatively-projected side of the stepped portion S. That is, in the entire surface coating, the coating gun 31 is controlled such that a target angle of the coating gun 31 (an angel formed by the bell's center line and the side panel) will be a right angle, whereas in the follow-up coating, the coating gun 31 is controlled such that a target angle $\alpha$ will be, for example, 40 to 80 degrees as shown in FIG. 7. This technique allows one side of the coating gun 31 to be close to the relatively-recessed side of the stepped portion S, and is advantageous in making the paint mist 36 adhere more to the recessed side.

Further, in the follow-up coating, the moving direction of the coating gun 31 is controlled according to a positional relationship between the relatively-projected side and the relatively-recessed side of the stepped portion S. This will be explained in detail below.

Figure 8:
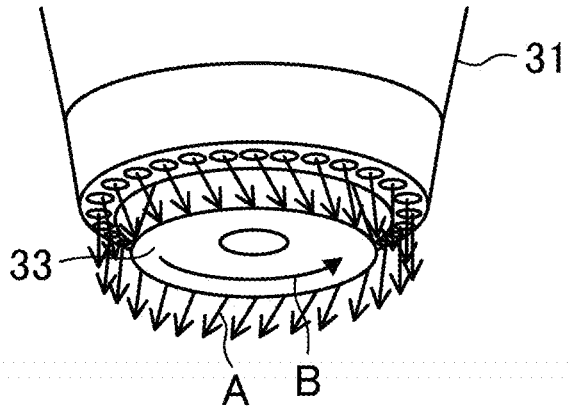
FIG. 8 shows part of a rotating bell-type coating gun, a swirling air flow when the coating gun is stopped, and thickness distribution of the coating film.
Figure 8:
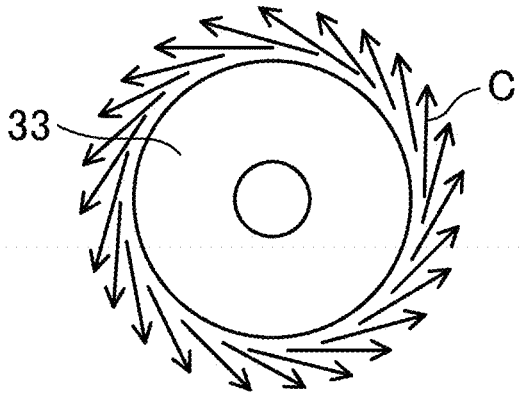
Figure 8:
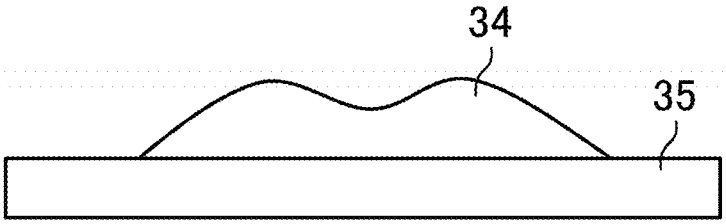

As shown in FIG. 8(A), a blow-out direction A of shaping air of the coating gun 31 is tilted in a direction opposite to the rotation direction B of the bell 33. Even in this state, as shown in FIG. 8(B), a swirling air flow C is generated due to the rotation of the bell 33, and the paint mist is ejected to the coating target 35, while swirling about the center of the bell 33. Thus, when the coating gun 31 is stopped, the thickness of the coating film 34 is a rotational symmetry about the bell's center line, that is, relatively thin at a central portion, thicker around the central portion, and gradually becomes thin toward its periphery, as shown in FIG. 8(C).

Figure 9:
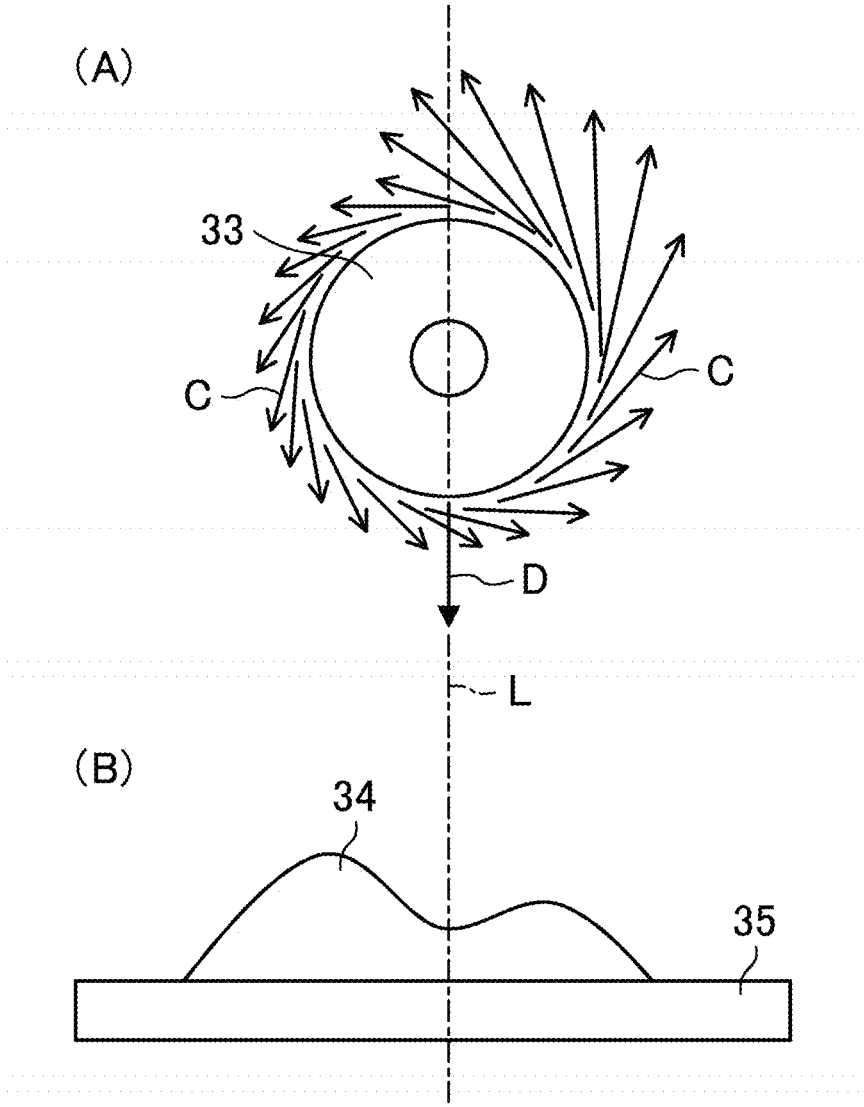
FIG. 9 shows a swirling air flow when the rotating bell-type coating gun is moving, and thickness distribution of the coating film.

On the other hand, as shown in FIG. 9(A), when the coating gun 31 is moved in one direction D, while spraying the paint, swirling of the paint mist is reduced on one side (left side in the drawing) of a movement line of the bell center, due to air resistance caused by the movement of the coating gun 31. As a result, straightness of the paint mist going to the coating target from the coating gun 31 increases, and therefore, an amount of adhesion of the paint mist to the coating target is increased near the coating gun. On the other side of the movement line of the bell center, the paint mist is easily scattered due to the air resistance, and therefore, the amount of adhesion of the paint mist to the coating target is reduced near the coating gun. That is, as shown in FIG. 9(B), the coating film 34 is thick on one side of the movement line L of the bell center, and thin on the other side.

Thus, in the follow-up coating in the second coat section 22, the moving direction of the coating gun 31 is controlled such that the one side where swirling of the paint mist is reduced due to air resistance caused by the movement of the coating gun 31 (i.e., the side where the film thickness is thin) faces the relatively-recessed side of the stepped portion S. In the case of the automobile 1, the left side surface and the right side surface are facing in opposite directions, and the shape of the stepped portion S of the left side surface and the shape of the stepped portion S of the right side surface are symmetrical with respect to a central plane extending in the longitudinal direction in the middle of the automobile 1. Thus, the moving direction of the coating gun 31 for the left side surface and the moving direction of the coating gun 31 for the right side surface are opposite to each other in the follow-up coating.

Figure 10:
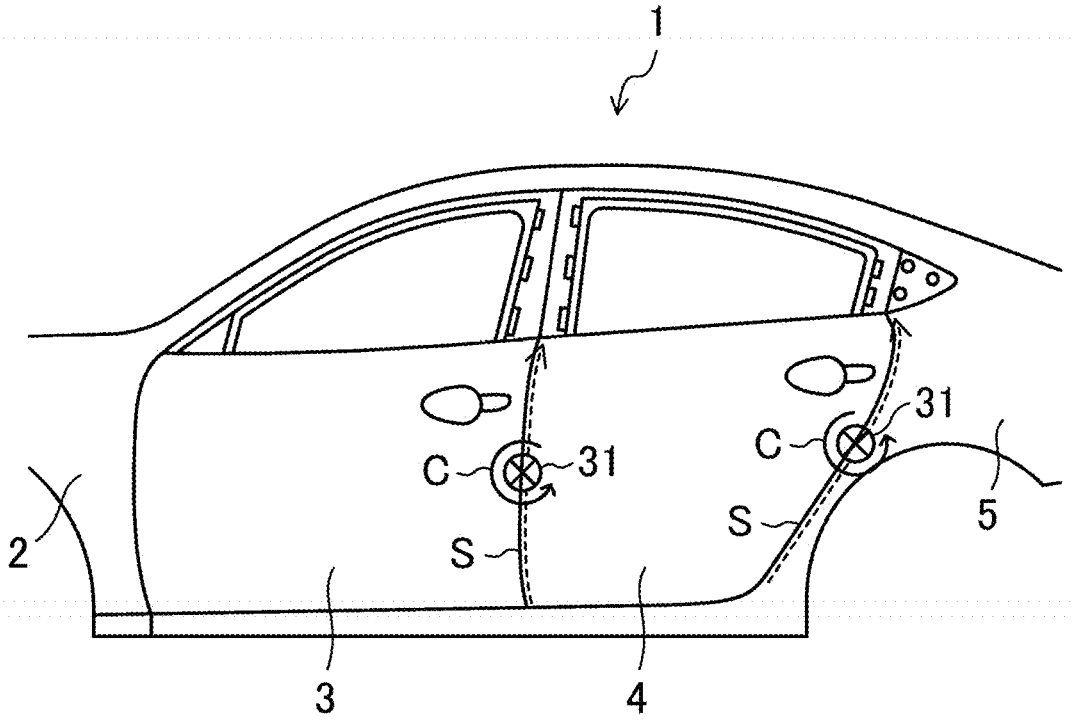
FIG. 10 is a side view showing a moving direction of the coating gun during the follow-up coating on the left side surface of the automobile.

Specifically, as shown in FIG. 10, when a counter clockwise swirling flow C is generated by the rotation of the bell 33, swirling of the paint mist on the right side of the moving direction of the coating gun 31 is reduced. Thus, on the left side surface of the automobile 1, the side coating robot 23 is controlled such that the coating gun 31 moves along the vertically extending stepped portion S from the lower end to the upper end of the stepped portion S, as shown in broken line. This means that at the stepped portion S between the rear end of the front door 3 and the front end of the rear door 4, the front end side of the rear door 4 is located on the right side (i.e., the side where the swirling of the paint mist is reduced) of the movement direction of the coating gun 31. Thus, although the front end side of the rear door 4 is relatively recessed, the paint mist can easily adhere to the front end side of the rear door 4. At the stepped portion S between the rear end of the rear door 4 and the front end of the rear fender 5, the paint mist can easily adhere to the relatively-recessed front end side of the rear fender 5 as a result of the movement of the coating gun 31 along the stepped portion S from the lower end to the upper end of the stepped portion S.

Figure 11:
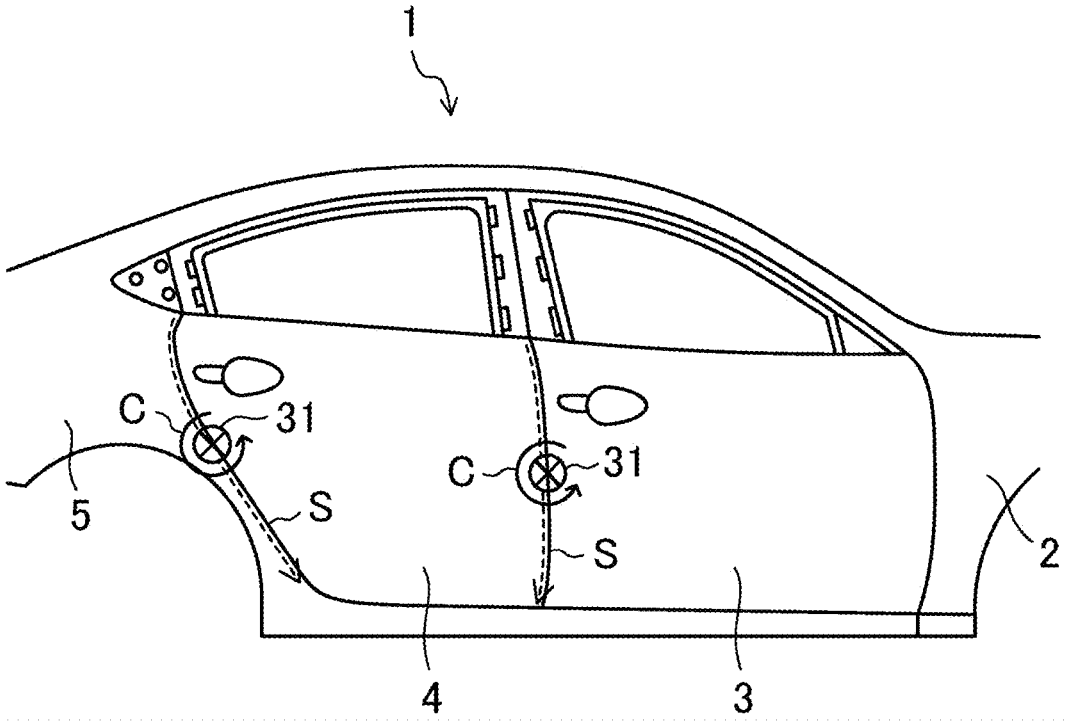
FIG. 11 is a side view showing a moving direction of the coating gun during the follow-up coating on the right side surface of the automobile.

On the other hand, as shown in FIG. 11, on the right side surface of the automobile 1, the side coating robot 23 is controlled such that the coating gun 31 moves along the vertically extending stepped portion S from the upper end to the lower end of the stepped portion S, as shown in broken line. This means that at the stepped portion S between the rear end of the front door 3 and the front end of the rear door 4, the front end side of the rear door 4 is located on the right side of the movement direction of the coating gun 31. Thus, the paint mist can easily adhere to the relatively-recessed front end side of the rear door 4. At the stepped portion S between the rear end of the rear door 4 and the front end of the rear fender 5, as well, the paint mist can easily adhere to the relatively-recessed front end of the rear fender 5 as a result of the movement of the coating gun 31 along the stepped portion S from the upper end to the lower end of the stepped portion S.

In the above follow-up coating, the coating gun 31 is held in the obliquely spraying posture shown in FIG. 7, and the follow-up coating on each of the stepped portions S is provided by only 1 pass of the coating gun 31.

The top panels, too, are coated with the second base coating film 12 by using the top coating robots 24 on both sides of the carrier line, and moving the coating gun 32 along a predetermined path.

Figure 12:
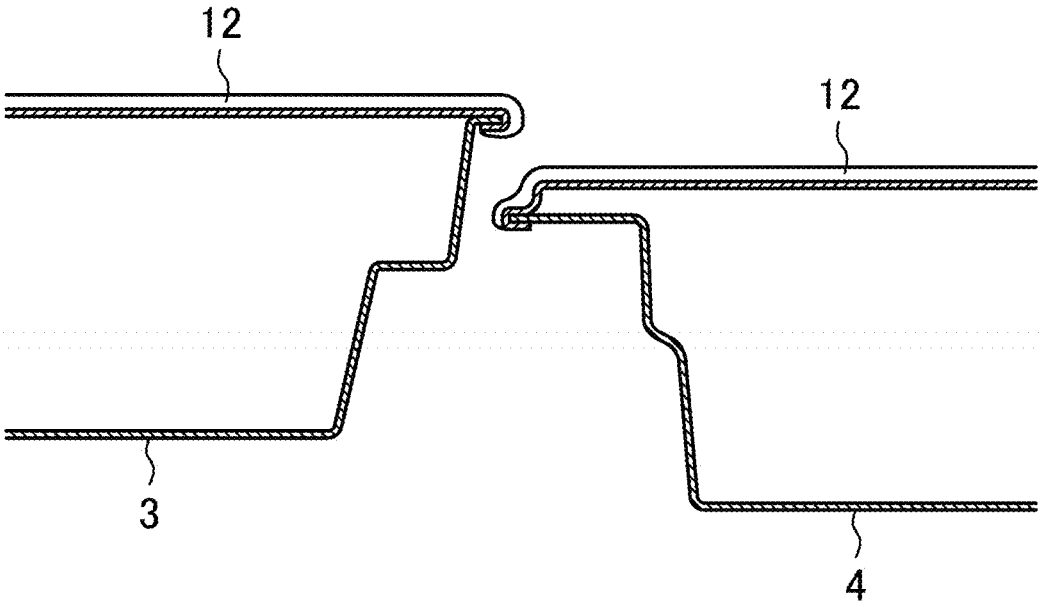
FIG. 12 is a cross-sectional view of part of the automobile, in which the thickness of the coating film after the follow-up coating is drawn exaggeratedly.

In the above embodiment, as described above, the follow-up coating on the stepped portion S is provided after the entire surface coating, in forming the second base coating film 12 on the side panels 2-5. In the follow-up coating, the moving direction of the coating gun 31 is controlled such that the one side where swirling of the paint mist is reduced due to air resistance caused by the movement of the coating gun 31 faces the relatively-recessed side of the stepped portion S. Further, an oblique spray of the paint is adopted. Thus, as in the example cases of the doors 3, 4 shown in FIG. 12, it is possible to form the second base coating film 12 having an approximately uniform thickness on the entire surfaces of the side panels 2-5 even in the case where the step is relatively large, due to an increase in the straightness of the paint mist as a result of a reduction in swirling of the paint mist on the relatively-recessed side of the stepped portion S, and closer positioning of the coating gun 31 to the relatively-recessed side by the oblique spray.

If the step is small, the follow-up coating may be provided by the direct facing spray in which the one side where swirling of the paint mist of the coating gun 31 is reduced faces the recessed side of the stepped portion S, or may be provided by only the oblique spray without making the one side where swirling of the paint mist of the coating gun 31 is reduced, face the recessed side of the stepped portion S.

The follow-up coating along the stepped portion may be provided by two or more passes of the coating gun 31 in the same direction as necessary.

Further, the coating method and the coating device of the present invention are not limited to use for coating of an automobile, but are generally applicable to any coating targets, such as home appliances.

DESCRIPTION OF REFERENCE CHARACTERS

1 automobile
2 front fender
3 front door
4 rear door
5 rear fender
12 coating film
23 coating robot
31 rotating bell-type coating gun
S stepped portion

The invention claimed is:

1. A method for providing an electrostatic coating on a coating target having, on a coating surface, a stepped portion extending in a predetermined direction where the stepped portion is defined as a portion having a relatively projected side and a relatively recessed side, the method comprising:

a first step of providing an entire surface coating on the entire coating surface of the coating target; and a second step of providing, after the entire surface coating, a follow-up coating along the stepped portion extending in the predetermined direction so that paint mist adheres more to the relatively-recessed side of the stepped portion, wherein a rotating bell-type coating gun by which the paint mist is supplied while swirling about a center of a bell is used in the follow-up coating, and when the coating gun is moved in one direction along the stepped portion extending in the predetermined direction, swirling of the paint mist is reduced on one side of a movement line of a bell center of the coating gun due to air resistance caused by the movement of the coating gun, and the coating gun is moved only in the one direction along the stepped portion, with the one side facing the relatively-recessed side of the stepped portion.

2. The method of claim 1, wherein the coating target includes a pair of coating surfaces facing in opposite directions with respect to a center plane extending between the pair of the coating surfaces, and the coating surfaces have the stepped portions arranged symmetrically with respect to said center plane, and in the follow-up coating, the coating gun moves along the stepped portions on the coating surfaces of the coating target in opposite directions so that the one side where the swirling of the paint mist is reduced due to the air resistance caused by the movement of the coating gun face the relatively-recessed side of each of the stepped portions on the coating surfaces of the coating target.

3. The method of claim 1, wherein the follow-up coating is provided by only 1 pass of the coating gun along the stepped portion.

4. The method of claim 1, wherein after the entire surface coating using a coating gun, the follow-up coating is provided using the same coating gun.

5. The method of claim 1, wherein the follow-up coating is provided by an oblique spray of paint from the relatively-recessed side to a relatively-projected side of the stepped portion, using a coating gun.

6. The method of claim 1, wherein a coating film formed by the entire surface coating and the follow-up coating has a visible light transmittance of 40% or more and 70% or less.

* * * * *